United States Patent [19]

Cherednichenko et al.

[11] 4,045,006

[45] Aug. 30, 1977

[54] APPARATUS FOR CONTINUOUS VACUUM-REFINING OF METALS

[76] Inventors: Vladimir Semenovich Cherednichenko, ulitsa Zorge, 269, kv. 79, Novosibirsk; Valentin Innokentievich Belsky, ulitsa Zorge, 70, kv. 6, Novosibirsk; Gennady Ivanovich Orlov, ulitsa Vatutina, 27, kv. 20, Novosibirsk; Jury Anatolievich Naryshkin, ulitsa Bljukhera, 7, kv. 55, Novosibirsk; Jury Petrovich Novikov, Leninsky prospekt, 30, kv. 19, Moscow, all of U.S.S.R.

[21] Appl. No.: 600,864

[22] Filed: July 31, 1975

[51] Int. Cl.[2] ..... F27B 17/00; F27D 7/06

[52] U.S. Cl. ..... 266/149; 266/208; 13/31

[58] Field of Search ..... 266/19, 34 R, 34 V, 266/148, 149, 151, 153, 208–211; 13/31; 75/66, 85, 88

[56] References Cited

U.S. PATENT DOCUMENTS

| | | | |
|---|---|---|---|
| 2,239,370 | 4/1941 | Osborn et al. | 266/34 R |
| 2,848,523 | 8/1958 | Hanks et al. | 13/31 |
| 3,803,335 | 4/1974 | Esjutin et al. | 266/34 V |

FOREIGN PATENT DOCUMENTS

| | | | |
|---|---|---|---|
| 1,483,070 | 2/1969 | Germany | 266/149 |
| 1,159,918 | 7/1969 | United Kingdom | 266/149 |

*Primary Examiner*—Roy Lake
*Assistant Examiner*—Paul A. Bell

[57] ABSTRACT

Apparatus for the continuous vacuum refining of a metal comprising a cylindrical vacuum chamber, containing a stack of a plurality of vertically superposed trays. The trays receive impure molten metal which flows downwardly from tray to tray while impurities are discharged therefrom and flow to shields which surround the trays and condense and discharge the impurities. The metal in the trays is heated to evaporate the impurities therefrom. The heat energy which is imparted to the metal is effected irregularly along the height of the stack of the trays such that the imparted heat energy diminishes in a vertically downwards direction.

7 Claims, 6 Drawing Figures

APPARATUS FOR CONTINUOUS VACUUM-REFINING OF METALS

FIELD OF THE INVENTION

The present invention relates to apparatus for metal processing and more particularly to apparatus for continuous vacuum-refining of metals.

The present invention may prove to be most advantageous for producing pure tin with impurity contents of not more than 2 percent.

BACKGROUND

An existing apparatus for continuous vacuum-refining of metals comprises a cylindrical vacuum chamber accommodating a range of graphite trays arranged in succession one above another in a vertical plane, forming a column and adapted to receive preliminary melted impure metal, a central heater with a current lead for feeding electric power for heating the metal accommodated in the trays and for evaporating low-boiling impurities therefrom, and perforated shields for trapping impurity vapors referred to hereinafter as volatilized impurities liberated during evaporation, for condensing and draining the impurities into a condensate tank. Each shield is a cylinder mounted along the entire height of the tray column and not linked mechanically with the adjacent shield. Since the process of fabrication of the central coretype heater is a very complicated one, it has one and the same diameter all along its length, a feature precluding irregular distribution of generated energy along the chamber height.

A disadvantage of this apparatus resides in a low yield stipulated largely by the rate at which the volatilized impurities are drawn from the surface of molten metal accommodated in the trays. In the present-art apparatus the above process is determined by the rate of evaporation of impurities at their boiling temperature and by vapor diffusion in all directions. At present devices for intensifying the rate of withdrawal of volatilized impurities from the surface of molten metal are not available.

Another disadvantage inherent in the design of the vacuum-refining apparatus in current use lies in that it is impossible to ensure irregular distribution of energy, produced in the heater, along the height of the column formed by the trays mounted one above another.

The need for such an irregular distribution of energy along the height of the graphite tray column is dictated by the physics of the refining process.

In the first place, the refining process can proceed only at temperatures sufficient for boiling and evaporation of impurities present in metal being refined. Hence, the preliminary melted metal admitted into the vacuum chamber of the above apparatus should be heated to a temperature of evaporation of the impurities in the upper trays. Secondly, the upper trays accommodate the metal most contaminated with impurities.

Each unit of mass of impurities requires a certain amount of energy for its evaporation and since the mass of the impurities evaporating in the upper trays is a maximum one, naturally, it requires a larger amount of energy to be generated in the zone of location of the upper trays.

With the now-existing design of the central core-type heater the redistribution of the produced energy along the height of the tray column will require a heater of a variable (along its height) cross-section, and this presents a problem from the constructional standpoint and diminishes still more the inadequate durability of the heater.

As it has been stated above, the maximum amount of impurities evaporates from the upper trays. Over 60% of the total amount of such vapors are given off by the tray section which accounts for one-third of the height of the graphite trays in the upper part of the vacuum chamber. The middle third of the height of the graphite tray column accounts for almost 25% and the lower third for maximum 10% of the volatilized impurities liberated. This results in an increase in the partial pressure of the volatilized impurities in immediate proximity to the trays. The amount of energy given off by the volatilized impurities to the shields during their condensation is higher in the upper portion of the shields than in the middle and lower ones.

The inherent design of the present-art apparatus does not envisage the redistribution of energy generated by the heater along the column height; it ignores also the difference (along the column height) in the amount of energy given off by the volatilized impurities to the shields, which diminishes the stability of the refining process.

Finally, a fourth disadvantage of the apparatus design in current use lies in lower durability of the condensate tank which is due to the fact that the impurities withdrawn from the metal react actively with the material of the condensate tank at condensation temperatures.

SUMMARY OF THE INVENTION

The main object of the invention is the provision of an apparatus for continuous refining of metals, wherein owing to the creation of means for ejecting impurities and redistributing the generated energy along the column height the apparatus output is enhanced.

Another object of the invention is the provision of an apparatus for continuous refining of metals equipped with the above specified means which decreases the specific consumption of electric energy.

It is an important object of the invention to provide an apparatus for continuous refining of metals which enhances the stability of the refining process.

No less an important object of the invention is the prevision of an apparatus for continuous refining of metals which improves the quality of metal being refined.

Said and other objects are achieved in an apparatus for continuous refining of metal, comprising a cylindrical vacuum chamber accommodating a range of graphite trays arranged in tiers one above another in a vertical plane and adapted to receive preliminary melted impure metal, a heater with a current lead to feed electric power thereto for heating the metal accommodated in the trays and for evaporating low-boiling impurities therefrom and perforated shields encompassing the trays and adapted to trap volatilized impurities liberated during evaporation, for condensing and draining the impurities into a condensate tank, wherein, according to the invention, a hood shaped as a truncated cone facing the tray with its enlarged portion is mounted above each tray and the tray diameter in each tier grows gradually in a vertical direction downward so that each subsequent tray is larger in diameter than the preceding one, and each hood overlaps partly the vertical walls of the tray with its lateral face forming a clearance for the effluence of evaporating impurities and for ejecting the volatilized impurities evaporating from the underlying tray, with the trays and hoods forming in conjunction a cone-shaped metal-refining column, and wherein a means is provided for irregular distribution of energy generated by the heater along the column height, said means being arranged within the vacuum chamber.

Owing to the clearances formed between the internal surfaces of the hoods and the external side surface of the trays and directing the flow of volatilized impurities from each tray to one side, i.e. to the lower part of the tray column, a vapor ejecting effect is created, i.e. the vapors from the underlying trays are ejected by those from the overlying trays, this increasing the rate of vapor withdrawal from the surface of the metal being refined. This results in a higher output of the proposed apparatus, a lower specific energy consumption, improves the stability of the refining process and the quality of metal being refined.

According to the invention, a means for irregular distribution of energy along the column height serves as a means for stabilizing thermal conditions of the metal refining process along the column height, said means for irregular distribution of energy along the column height comprising an overflow pipe for a stream of metal being refined, set up in the bottom of each tray and having a section protruding above the bottom, with the section length in each underlying tray being larger than that in the overlying tray, wherein each tray is provided with a vertical partition disposed along the radius on one side of the tray centerline and extending along the entire tray height, said partition forming two zones, of which one is adapted to receive the metal and another to discharge it, said means comprising also a graphite socket mounted above the upper tray, acting as a current lead and immersed into the molten metal accommodated in this tray with the metal acting as a heater and the lower tray being electrically associated with the casing of the vacuum chamber.

It is known that the amount of generated energy varies in proportion to the resistance of an energy conductor. By varying the height to which the tray is filled with metal being refined, the energy produced in the tray can be changed. The overflow pipe along which the metal being refined passes from one tray into another acts as an element adjusting the height of the metal in the tray. Obviously, the height of the metal in the tray is determined by the length of the overflow pipe section protruding above the tray bottom.

To provide for the passage of electric current along the entire volume of the metal being refined the tray is furnished with the vertical partition disposed along the radius on one side of its centerline, with the metal to be refined being admitted into the tray on one side of the vertical partition and discharged on its other side.

In the upper intake tray the molten metal fed by the overflow pipe forms a layer of a certain height into which the graphite socket acting as a current lead is immersed.

Each tray or group thereof is electrically insulated from one another and the lower tray is electrically associated with the casing of the vacuum chamber (grounded) which acts as the second terminal of an electric circuit.

Another arrangement aimed at stabilizing the thermal conditions of the refining process along the height of the tray column provides for the use of condensing shields sectionalized along their height. The system of condensing shields is subdivided along their height into two or more sections accordingly. The shields of each section are linked mechanically with one another by which reason each section constitutes an integral unit, a feature simplifying considerably both the assembly and operation of the proposed apparatus.

The number of the shields in each section changes being half, and even more, in each underlying section. The above distribution of the shields is stipulated by the amount of volatilized impurities escaping from the metal along the column height.

To extend the service life of the condensate tank and to cut down the flow path of hot condensed impurities in the apparatus, the condensate tank is built into the lower portion of the vacuum chamber casing and is provided with water cooling. The ensuing intensified heat removal from the tank body causes accretions (a thin crust of solidified metal) to be formed on the internal surface of the tank. The above accretions protect the tank from interaction with liquid hot impurities. The above-outlined constructional features of the apparatus ensure an enhanced out-put, increase the degree of refining of the metal, stabilize the thermal process within the apparatus, alleviate working conditions in the course of erection and operation, enhance durability of the apparatus elements and its dependability in service.

BRIEF DESCRIPTION OF THE DRAWING

The nature of the invention will be clear from the following detailed description of the particular embodiment of an apparatus for purifying tin from lead and bismuth, to be had in conjunction with the accompanying drawings, in which.

DETAILED DESCRIPTION

Figure 1:
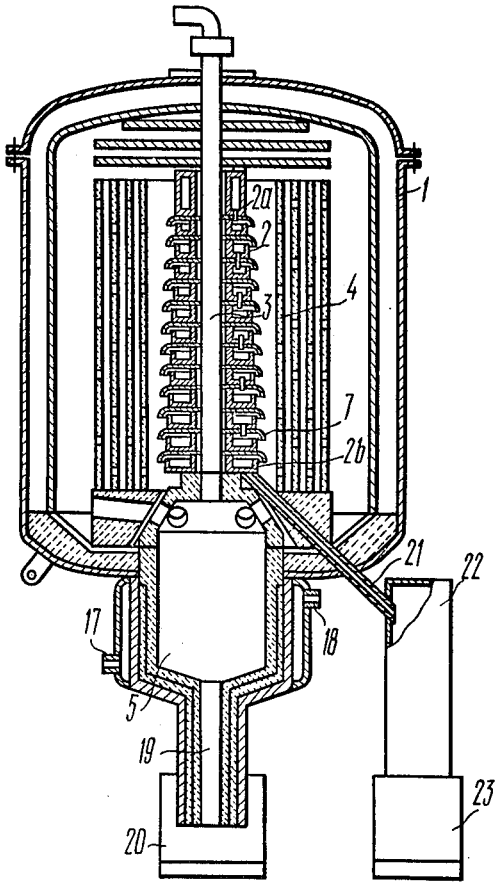
FIG. 1 is a longitudinal sectional view of the apparatus, according to the invention.

An apparatus for continuous vacuum-refining of tin comprises a cylindrical vacuum chamber 1 (FIG. 1).

The chamber 1 accommodates a range of trays 2 adapted for heating tin to a temperature of evaporation of impurities and for their evaporation from the tin being refined, a heater 3 for heating the tin accommodated in the trays, and shields 4 providing for the condensation of volatilized impurities and their draining into a condensate tank 5.

Figure 2:
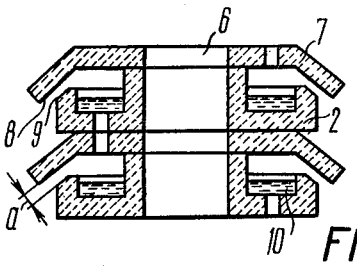
FIG. 2 shows the element of the tray column with hoods.

The trays 2 have an annular groove for the passage of the tin being refined, and a central hole 6 accommodating the coretype heater 3 (FIG. 2).

To increase the rate of withdrawal of the volatilized impurities from the surface of the tin being refined, there is mounted above each tray a hood 7 (FIGS. 1 and 2) shaped as a truncated cone facing the tray with its enlarged portion, and the diameter of the trays in the tier is gradually increased in a vertical direction downward so that each tray is larger in diameter than the preceding one. Each hood 7 overlaps partly vertical walls 9 of the tray 2 with its lateral face 8 forming a clearance "a" for the passage of evaporating impurities and for ejecting the volatilized impurities evaporating from the underlying tray.

The trays 2 and hoods 7 form in conjunction a cone-shaped column.

Figure 3:
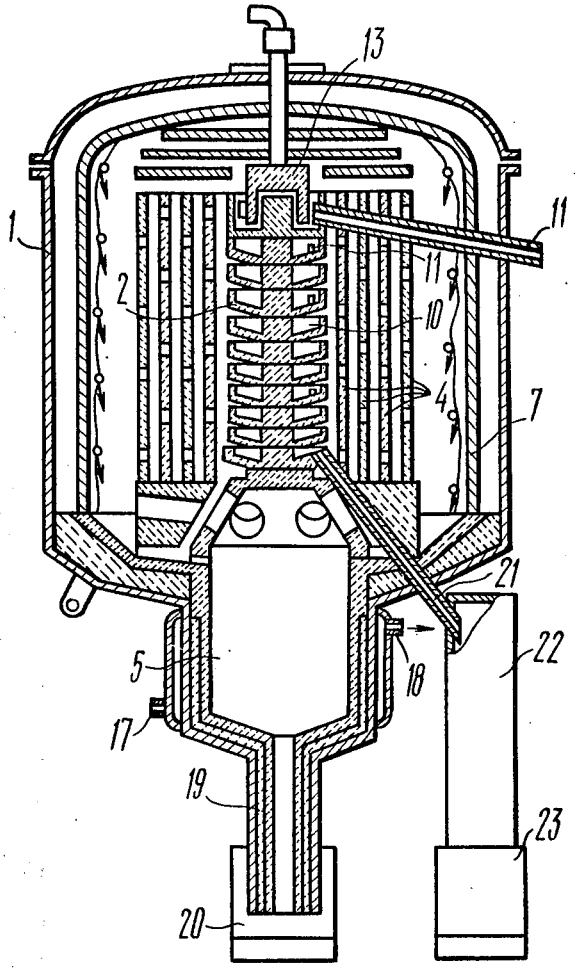
FIG. 3 is a longitudinal sectional view of the proposed apparatus, wherein metal being refined is employed as a heater.
Figure 4:
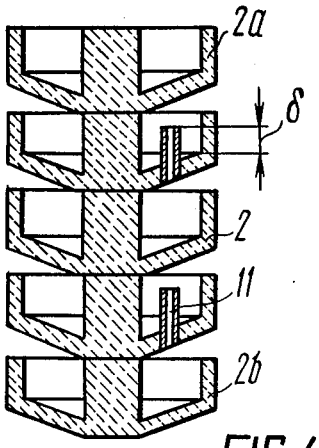
FIG. 4 shows the trays with overflow pipes adjusting the height of the metal in the trays.
Figure 5:
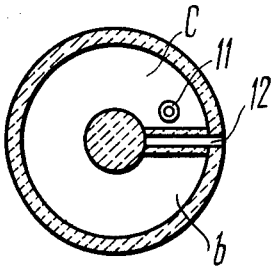
FIG. 5 same, as shown in FIG. 4, a top view.

FIG. 3 shows a metal-refining apparatus wherein metal 10 being refined is used as a heater. To stabilize the refining process, the apparatus is provided with a means for irregular distribution of energy along the column height. The means comprises an overflow pipe 11 (FIGS. 3 and 4) mounted in the bottom of each tray 2. The overflow pipe 11 has a section protruding above the tray bottom, with the section length "δ" of each underlying tray being larger than that of a similar section of the overlying tray. Each tray 2, except an upper one 2a, has a vertical partition 12 (FIG. 5) disposed along the tray radius on one side of its center line and running along the entire tray height. The partition 12 forms two zones in the trays: a metal inlet zone "b" and a metal discharge zone "c".

To feed electric energy to the molten metal, provision is made for two current leads of which one is a graphite socket 13 (FIG. 3) immersed into the layer of the molten metal 10 in the upper tray 2a, with a lower tray 2b of the tray column being associated electrically with the casing of the vacuum chamber 1 acting as a second current lead.

Figure 6:
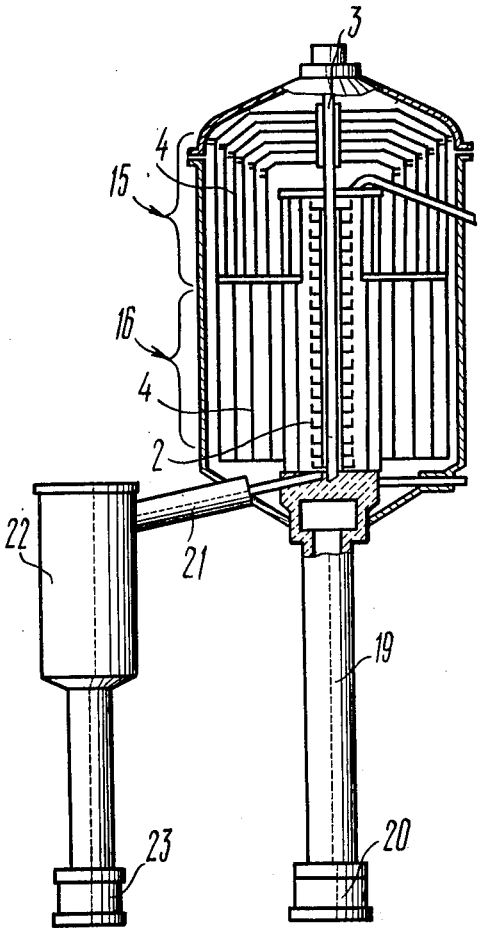
FIG. 6 is a longitudinal sectional view of the proposed apparatus with sectionalized condensing shields.

Shown in FIG. 6 is an apparatus in which the means for irregular distribution of energy comprises shields 4 subdivided into sections: namely, an upper section 15 and a lower one 16 with the number of the shields in the upper section being two times greater than in the lower section 16.

In each section, the shields located near the column center are made of graphite and perforated. These shields are adapted for condensing the volatilized impurities. The rest of the shields are of a solid heat-resistant metal. These shields serve as heat insulation (diminishing the heat flux to the vacuum chamber shell).

The lower shield section 16 communicates with the watercooled condensate tank 5 (FIG. 3). Water is supplied to the tank 5 along a branch pipe 17 and discharged along a branch pipe 18.

The impurities in a liquid state run off from the condensate tank 5 through a barometric pipe 19 into a condensate tank 20 and pure tin is discharged from the vacuum chamber 1 along a pipeline 21 first to a cooler 22 where it is cooled and then to a tin receiving tank 23.

The impurities and refined tin from the tanks 20 and 23 are poured into pigs.

The herein-proposed apparatus operates in the following manner.

Preliminary melted impure tin is fed into the vacuum chamber 1 in the upper tray 2a. Owing to the energy generated in the heater 3 the trays 2 and the tin accommodated therein are heated to a temperature at which impurities commence to evaporate.

Volatilized impurities flow through the clearance "a" formed by the hood 7 and the side wall 9 of each tray 2 beyond the limits of the tray column. The lateral face 8 of the hood 7 and the clearance "a" create a directed flow of vapors moving at a certain speed. The volatilized impurities flowing off from the underlying clearance "a" are entrained by the vapor flow from the overlying tray.

Thus, along the entire height of the column the vapor flow is directed downwards. This vapor flow comes in contact with the internal surface of the first perforated shield 4 made of graphite.

A fraction of vapors penetrate through the holes in this shield, then through those of the second one and so on. The shield temperature decreases from the center of the tray column to the shell of the vacuum chamber 1 and the volatilized impurities are condensed, flowing off along the surface of the shield into the lower part of the apparatus where they get into the condensate tank 5.

Another fraction of the vapor flow is passed directly to the condensate tank 5 where it is condensed owing to an intense heat removal by the water-cooled jacket of the condensate tank.

In the condensate tank 5 the temperature of liquid condensate drops to 350°–450° C. The liquid condensate flows along the barometric pipe 19 into the condensate tank 20 from which it is poured into pigs for subsequent conversion.

The tin being refined proceeds through an overflow conduit or along the overflow pipe 11 from the upper tray 2a into the underlying tray and so on, passing in succession all the trays 2 up to the last tray 2b communicating through the pipeline 21 with the cooler 22, where the refined tin is cooled to a temperature of 350°–450° C and is drained into the tank 23 for pure tin, wherefrom it is poured into pigs.

An apparatus presented in FIG. 3 differs from the above outlined in that instead of the central core-type heater 3 metal 10 being refined is utilized as a heater. The height of the metal in the tray is adjusted by means of the overflow pipe 11, with the energy generated being thus distributed along the column height.

In this case the electric energy is fed to the metal with the help of the graphite socket 13 immersed into the liquid metal in the upper tray 2a. As for the second current lead, use is made of the lower tray 2b associated electrically with the casing of the vacuum chamber 1.

In the apparatus illustrated in FIG. 6 the refining process proceeds similarly to that outlined above. The difference in their design, which consists in the use of sectionalized shields, affects only the thermal conditions along the height of the tray column.

What we claim is:

1. Apparatus for continuous vacuum refining of a metal comprising a cylindrical vacuum chamber, a stack of a plurality of vertically superposed trays disposed in said vacuum chamber for receiving impure molten metal and including interconnection means for flowing the metal downwardly from tray to tray while impurities are discharged therefrom, heater means in said vacuum chamber for heating of the metal in the trays and for evaporating the impurities therefrom, shield means in said chamber surrounding said trays for trapping volatilized impurities discharged from the trays and for condensing and discharging the impurities, and means for effecting irregular distribution of heat energy generated by the heater means along the height of the stack of trays such that the heat energy imparted to the trays diminishes in a vertically downwards direction.

2. Apparatus as claimed in claim 1 comprising a hood mounted above each said tray.

3. Apparatus as claimed in claim 4 wherein said interconnection means comprises an upstanding overflow pipe mounted in each tray for conveying molten metal to the next lower tray, said means for effecting irregular distribution of the heat energy being obtained by the provision wherein the height of the overflow pipes increases for successively lower trays, said heater means comprising an electrical current conductor operatively associated only with the uppermost tray, the trays being insulated from one another.

4. Apparatus as claimed in claim 3 wherein each tray includes a vertical partition disposed radially on one side of the tray center line, extending the entire height of the tray and adapted to form two zones one of which is adapted to receive the metal from the next upper tray and another to discharge the metal to the next lower tray, said heater means comprising a graphite socket mounted above the uppermost tray, and serving as a current lead immersed into the molten metal in this tray with the metal acting as a heat conductor, the lower tray being electrically connected with said vacuum chamber.

5. Apparatus as claimed in claim 1 wherein said means for effecting irregular distribution of the heat energy is obtained by the provision wherein said shield means comprises a plurality of shields arranged in upper and lower sections and wherein the number of shields in the upper section is greater than that in the lower section.

6. Apparatus as claimed in claim 1 wherein each of said trays includes a hood thereabove defining with said tray a clearance space for discharge of volatilized impurities to said shield means, said trays and associated hoods gradually increasing in diameter downwardly.

7. Apparatus as claimed in claim 6 wherein each said hood includes an inclined peripheral portion, the tray disposed below each hood having a vertical wall spaced from the hood and defining said clearance space therewith.

* * * * *